US012372100B2

(12) United States Patent
Nayak et al.

(10) Patent No.: US 12,372,100 B2
(45) Date of Patent: Jul. 29, 2025

(54) FLUID COMPRESSOR DEVICE WITH E-MACHINE AND PLURAL WORKING FLUID FLOW PATHS FOR E-MACHINE AND BEARING COOLING

(71) Applicant: Garrett Transportation I Inc., Torrance, CA (US)

(72) Inventors: Subhash Nayak, Bangalore (IN); Anup Varadkar, Pune (IN); Suryakant Gupta, Bangalore (IN); Poomkuzhimannil John, Bangalore (IN)

(73) Assignee: GARRETT TRANSPORTATION I INC., Torrance, CA (US)

( * ) Notice: Subject to any disclaimer, the term of this patent is extended or adjusted under 35 U.S.C. 154(b) by 158 days.

(21) Appl. No.: 18/171,724

(22) Filed: Feb. 21, 2023

(65) Prior Publication Data

US 2024/0209870 A1 Jun. 27, 2024

(30) Foreign Application Priority Data

Dec. 21, 2022 (IN) ..... 202211074219

(51) Int. Cl.
*F04D 29/58* (2006.01)
*F04D 25/06* (2006.01)
*F04D 29/057* (2006.01)

(52) U.S. Cl.
CPC ..... *F04D 29/582* (2013.01); *F04D 25/06* (2013.01); *F04D 25/0606* (2013.01); *F04D 29/057* (2013.01); *F04D 29/5806* (2013.01)

(58) Field of Classification Search
CPC ..... F04D 29/582; F04D 25/06; F04D 29/057; F04D 17/10; F04D 25/0606; F04D 29/5806
See application file for complete search history.

(56) References Cited

U.S. PATENT DOCUMENTS

| | | | | |
|---|---|---|---|---|
| 8,931,304 | B2 * | 1/2015 | Beers | F04D 29/584 62/505 |
| 9,863,430 | B2 * | 1/2018 | Lee | H01M 8/04089 |
| 2008/0199326 | A1 * | 8/2008 | Masoudipour | F04D 29/0513 417/247 |
| 2009/0044548 | A1 * | 2/2009 | Masoudipour | F25B 1/04 62/505 |
| 2013/0230382 | A1 * | 9/2013 | De Larminat | F04D 15/00 415/1 |

(Continued)

*Primary Examiner* — Dominick L Plakkoottam
(74) *Attorney, Agent, or Firm* — LORENZ & KOPF, LLP

(57) ABSTRACT

A fluid compressor device includes a compressor section and a motor section. The compressor device further includes a working fluid first flow path that extends in a downstream direction through the motor housing to the compressor inlet. The working fluid first flow path is configured to receive a first flow of a working fluid that flows downstream through the motor housing past the electric motor and into the compressor inlet to be compressed by the compressor section. Additionally, the compressor device includes a working fluid second flow path extending through the housing. The working fluid second flow path is configured to receive a portion of the working fluid from the compressor section and direct the portion to the bearing system before merging with the working fluid first flow path.

20 Claims, 3 Drawing Sheets

(56) References Cited

U.S. PATENT DOCUMENTS

| | | | | |
|---|---|---|---|---|
| 2014/0090413 | A1* | 4/2014 | Hiwata | F25B 1/10 62/468 |
| 2016/0003510 | A1* | 1/2016 | De Larminat | F25B 43/02 62/470 |
| 2017/0274728 | A1* | 9/2017 | Suzuki | B60L 58/33 |
| 2020/0256344 | A1* | 8/2020 | Sakota | F04D 29/057 |
| 2020/0259193 | A1* | 8/2020 | Sakota | F04D 25/06 |
| 2021/0293253 | A1* | 9/2021 | Chavez Castellanos | F04D 29/5806 |
| 2021/0293254 | A1* | 9/2021 | Chavez Castellanos | H02K 5/203 |

* cited by examiner

FLUID COMPRESSOR DEVICE WITH E-MACHINE AND PLURAL WORKING FLUID FLOW PATHS FOR E-MACHINE AND BEARING COOLING

CROSS REFERENCE TO RELATED APPLICATION

The following is a nonprovisional patent application claiming priority to Indian provisional patent application number 202211074219, which was filed on Dec. 21, 2022, the entire disclosure of which is incorporated by reference in its entirety.

TECHNICAL FIELD

The present disclosure generally relates to a fluid compressor device and, more particularly, relates to a fluid compressor device with an e-machine and plural working fluid flow paths for e-machine and bearing cooling.

BACKGROUND

Some turbomachines include an e-machine, such as an electric motor or electric generator. The turbomachine, the e-machine, etc. may generate heat during operation. The turbomachine may also operate in elevated thermal environments. Excessive heat may negatively affect the turbomachine. Accordingly, turbomachines have been proposed with features for cooling and otherwise maintaining operations within predetermined thermal conditions. Some of these turbomachines also include air bearing systems, which receive input gas to support and cool the bearing components.

However, there are challenges in providing these features. Fluid cooling systems may significantly decrease efficiency of the turbomachine. There may be a risk of introducing liquid coolant into the system, which may negatively affect operations. Including cooling features may disadvantageously increase the size and/or weight of the turbomachine. These features may also increase manufacturing costs, assembly time, or otherwise decrease manufacturing efficiency.

Thus, it is desirable to provide a turbomachine with an e-machine that includes improved cooling features. It is also desirable to provide such cooling features in a relatively compact and lightweight package. Furthermore, it is desirable to provide a turbomachine with highly effective cooling features using highly efficient manufacturing methods. Other desirable features and characteristics of the present disclosure will become apparent from the subsequent detailed description and the appended claims, taken in conjunction with the accompanying drawings and this background discussion.

BRIEF SUMMARY

In one embodiment, a fluid compressor device is disclosed that includes a housing and a rotating group. The compressor device including a bearing system that supports the rotating group for rotation within the housing about an axis of rotation. Furthermore, the compressor device includes a compressor section that is cooperatively defined by a compressor wheel of the rotating group and a compressor housing of the housing. The compressor housing includes a compressor inlet. Furthermore, the compressor device includes a motor section with an electric motor that is housed within a motor housing of the housing. Also, the compressor device includes a working fluid first flow path that extends in a downstream direction through the motor housing to the compressor inlet. The working fluid first flow path is configured to receive a first flow of a working fluid that flows downstream through the motor housing past the electric motor and into the compressor inlet to be compressed by the compressor section. Additionally, the compressor device includes a working fluid second flow path extending through the housing. The working fluid second flow path is configured to receive a portion of the working fluid from the compressor section and direct the portion to the bearing system before merging with the working fluid first flow path.

In another embodiment, a method of manufacturing is disclosed. The method includes providing a rotating group and supporting the rotating group about an axis of rotation within a housing with a bearing system to define a compressor section and a motor section. The compressor section is cooperatively defined by a compressor wheel of the rotating group and a compressor housing of the housing. The compressor housing includes a compressor inlet. The motor section includes an electric motor that is housed within a motor housing of the housing. Furthermore, the method includes defining a working fluid first flow path that extends in a downstream direction through the motor housing to the compressor inlet. The working fluid first flow path is configured to receive a first flow of a working fluid that flows downstream through the motor housing past the electric motor and into the compressor inlet to be compressed by the compressor section. Also, the method includes defining a working fluid second flow path extending through the housing. The working fluid second flow path is configured to receive a portion of the working fluid from the compressor section and direct the portion to the bearing system before merging with the working fluid first flow path.

In an additional embodiment, a motorized refrigerant compressor device is disclosed that includes a housing, a rotating group, and a bearing system that supports the rotating group for rotation within the housing about an axis of rotation. The compressor device also includes a compressor section that is cooperatively defined by a compressor wheel of the rotating group and a compressor housing of the housing. The compressor housing includes an axial opening, a compressor inlet that extends along the axis of rotation, and a re-direct segment extending in a downstream direction from the axial opening, and that turns radially to fluidly connect to the compressor inlet. The compressor device further includes a motor section that includes an electric motor that is housed within a motor housing of the housing. Furthermore, the compressor device includes a working fluid first flow path that extends in a downstream direction through the motor housing to the axial opening. The working fluid first flow path includes the re-direct segment. The working fluid first flow path is configured to receive a first flow of a working fluid that flows through the motor housing past the motor, into the axial opening, through the re-direct segment, and into the compressor inlet to be compressed by the compressor section and directed radially away from the compressor wheel to a compressor outlet of the compressor housing. Moreover, the compressor device includes a working fluid second flow path extending through the housing. The working fluid second flow path is configured to receive a portion of the working fluid from the compressor outlet and direct the portion to the bearing system before merging with the working fluid first flow path.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include a turbomachine with an e-machine, such as an electric-motor-assisted compressor device, which includes a compressor section that is operable to compress a working fluid (e.g., a refrigerant fluid in an HVAC fluid system). The compressor device also includes plural flow paths therethrough that route the working fluid, for example, through the e-machine and/or bearing system before the working fluid enters the compressor section. The compressor section may operate at high efficiency, and the working fluid may effectively cool the e-machine, support the bearing system, etc. In some embodiments, the compressor device may include a controller section that includes electronic components for controlling the e-machine (e.g., for controlling speed of the motor), and one or more of the working fluid flow paths may cool the controller section before the working fluid is introduced into the compressor section.

More specifically, in some embodiments, the turbomachine of the present disclosure may be an electrically motorized compressor device that compresses a refrigerant fluid (e.g., for an air conditioner system of a vehicle). The first and second working fluid flow paths may receive the refrigerant fluid to cool the motor and the bearings before these flow paths merge toward the inlet to the compressor section. In some embodiments, there may be a controller section for controlling the electric motor, and at least one of the flow paths may be routed through the controller section to provide cooling before the working fluid enters the compressor section.

Additionally, in some embodiments of the present disclosure, the compressor section may include one or more housing members that defines the first and second flow paths. Passages may extend in various directions, creating diverting branches and/or branches that merge together for directing the flows through the compressor device. In some embodiments, there may be a compressor housing cap member with an inner side facing axially toward an interior of the compressor device to cover over the compressor wheel. The compressor housing cap member may define a central opening that extends along the axis of rotation of the compressor wheel toward the compressor wheel. The compressor housing cap member may also include a re-direct segment that is upstream of the central opening. The re-direct segment may extend in a downstream direction from an axial opening at the inner side, may turn radially inward, and may turn back to extend axially and fluidly connect to the central opening for feeding the compressor section.

Figure 1:
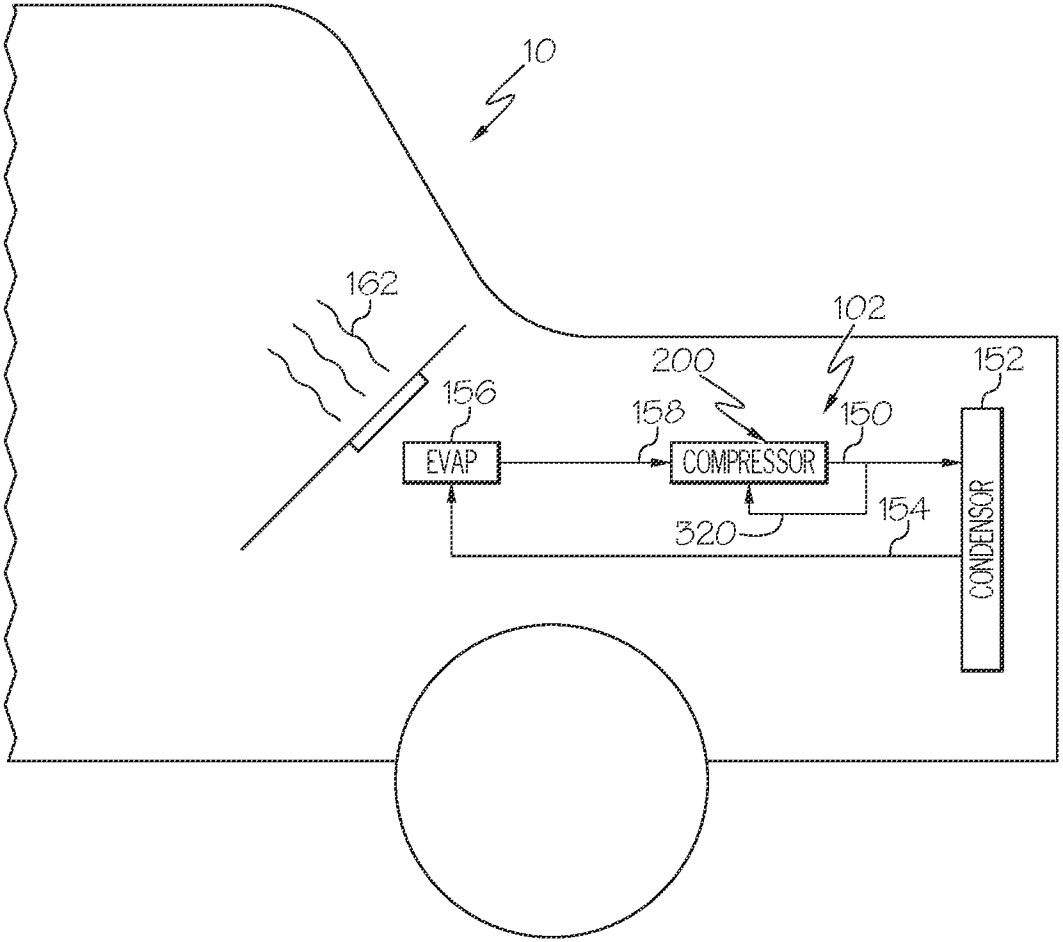
FIG. 1 is schematic illustration of a cooling system with a compressor device according to example embodiments of the present disclosure.

FIG. 1 is a schematic view of front end of a vehicle 10, such as a passenger car. The vehicle 10 may include a fluid system 102, such as a coolant fluid system, an air conditioning system, refrigerant cycle for an HVAC system, etc. The fluid system 102 may include a compressor device 200 configured according to example embodiments of the present disclosure. The compressor device 200 may compress a working fluid, such as a fluid refrigerant, and the pressurized fluid stream 150 may flow toward a condenser 152 of the fluid system 102. The condenser 152 may exchange heat with a surrounding fluid, and a resulting fluid stream 154 may flow toward an evaporator 156. The evaporator 156 may also be configured for heat exchange with a surrounding fluid, and the evaporator 156 may output a resulting input flow 158 back to the compressor device 200.

It will be appreciated that the evaporator 156 and/or condenser 152 may be operatively coupled to one or more fans (not shown) for exchanging heat with the surrounding fluid. It will also be appreciated that the fluid system 102 may include other standard components, such as an expansion valve, drier, etc. for use as the working fluid moves through the thermodynamic cycle within the fluid system 102.

In the embodiment illustrated, the evaporator 156 may be used to provide temperature-controlled air 162 to the cabin of the vehicle 10. In some embodiments, the fluid system 102 may be provided in an electric vehicle, a solar-powered car, a fuel-cell vehicle, or other vehicle 10.

It will also be appreciated that the compressor device 200 may be configured differently, may be incorporated within a different fluid system, etc., without departing from the scope of the present disclosure. Furthermore, features of the present disclosure may be included on a different turbomachine, such as an electric motor-assisted turbocharger, without departing from the scope of the present disclosure.

Figure 2:
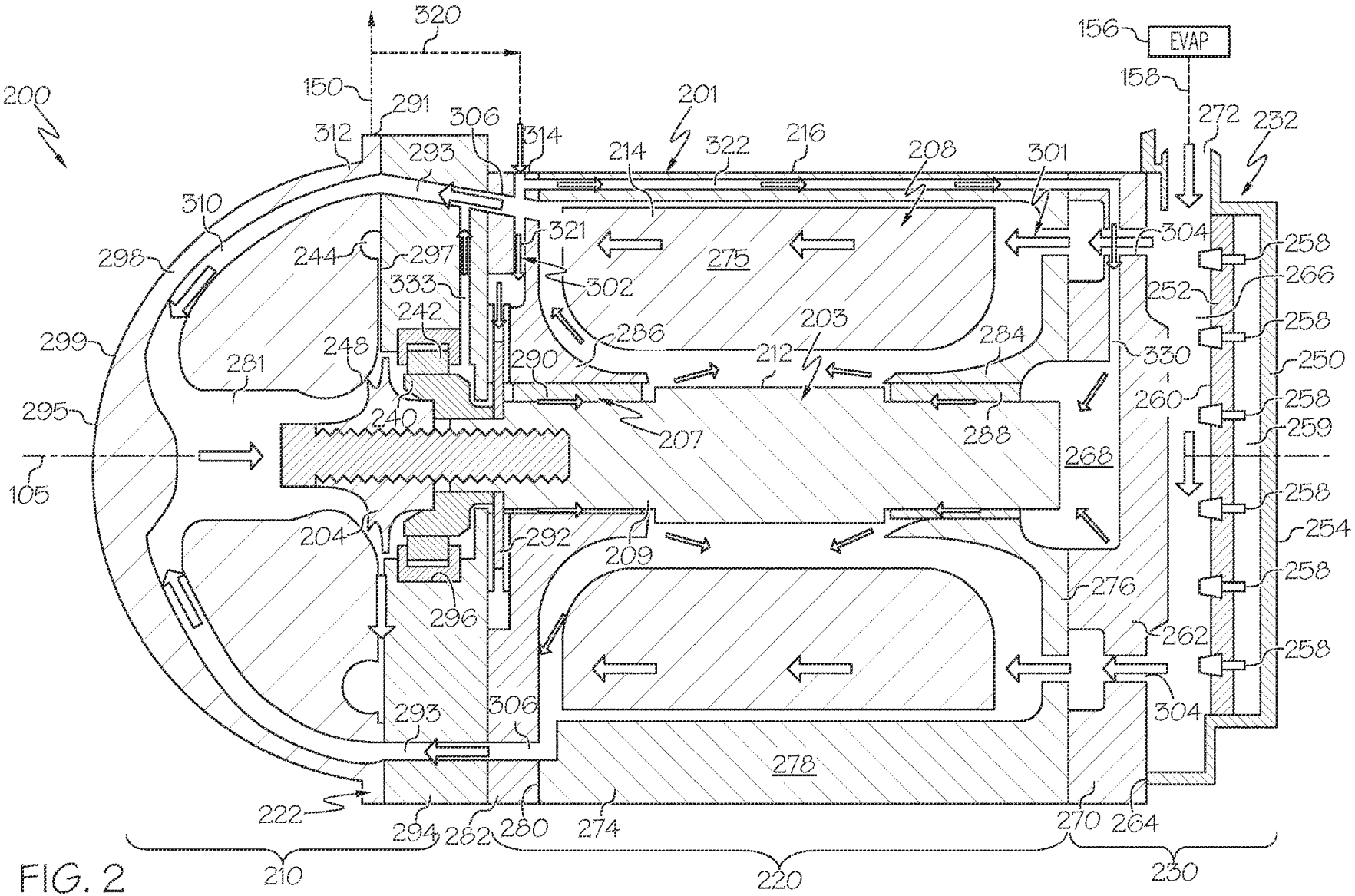
FIG. 2 is a cross-sectional schematic view of the compressor device of FIG. 1 according to example embodiments.

As shown in FIG. 2, the compressor device 200 may generally include a housing assembly 201 and a rotating group 203. The rotating group 203 may be supported for rotation within the housing assembly 201 about an axis 105 of rotation by a bearing system 207.

The rotating group 203 may include a shaft 209. The shaft 209 may extend between a compressor section 210 and a motor section 220 of the compressor device 200.

A compressor wheel 204 may be mounted on one end of the shaft 209, within the compressor section 210. The compressor wheel 204 may be housed within a compressor housing 222 of the housing assembly 201. Thus, the compressor housing 222 and compressor wheel 204 may cooperatively define the compressor section 210 of the compressor device 200.

The compressor device 200 may also include an e-machine, such as an electric motor 208 that is supported within the motor section 220. The electric motor 208 may include a rotor member 212 that is mounted on the shaft 209 and a stator 214 that is housed within a motor housing 216 of the housing assembly 201. Thus, the motor 108 and the motor housing 216 may cooperatively define the motor section 220 of the compressor device 200.

In some embodiments, the compressor device 200 may further include a controller section 230. The controller section 230 may include electronics (e.g., a circuit board and other circuit components for controlling the motor 208 as well as a controller housing 232 that houses the same.

The compressor section 210, the motor section 220 and the controller section 230 may be arranged along the axis 105 with the motor section 220 arranged therebetween along the axis 105.

The compressor housing 222, the motor housing 216, and the controller housing 232 of the housing assembly 201 may be defined by any number of components without departing from the scope of the present disclosure. These components may be configured, attached, or otherwise arranged in a number of ways to house the components discussed above.

For example, the controller housing 232 may include a cover member 250. The cover member 250 may be plate-shaped, bowl-shaped, etc. The cover member 250 may be hollow and shallow. The cover member 250 may define a first axial end 254 of the compressor housing 222 and an exterior surface of the compressor device 200. An invertor member 252 may be supported at one or more radial ends underneath the cover member 250, and circuit components, such as a plurality of MOSFET chips 258 may be supported on or proximate a first face 259 of the invertor member 252. A second face 260 may face axially, opposite the first face 259. The invertor member 252 may be thermally conductive so as to conduct heat in a direction from the first face 259 toward the second face 260.

The controller housing 232 may be attached to an end plate 262. An outer rim 264 of the cover member 250 may be attached against the end plate 262 with the invertor member 252 and plurality of MOSFET chips 258 (as well as other components of the controller section 230) housed between the end plate 262 and the end plate 262. The end plate 262 may be disc-shaped with a central recess 268 therein centered on the axis 105. The end plate 262 may also in an outer radial area 270.

As shown in FIG. 2, the second face 260 may be spaced apart from the end plate 262 so as to define an inlet cavity 266 therebetween. The cover member 250 may also include a first inlet 272. The first inlet 272 may be directed radially through the cover member 250 and may fluidly connect to the inlet cavity 266.

The motor housing 216 may be partly defined by a first motor housing member 274. The first housing member 274 may be hollow and barrel-shaped with a first axial end 276, an outer radial portion 278, and an open second axial end 280. The motor housing 216 may be further defined by a bearing housing member 282 that is fixed to the second axial end 280. Together, the first motor housing member 274 and the bearing housing member 282 may cooperatively define a motor cavity 275 of the motor housing 216 that houses the stator 214 of the motor 208.

The first axial end 276 of the first motor housing member 274 may include a first bearing support portion 284. Similarly, the bearing housing member 282 may include a second bearing support portion 286.

The bearing system 207 may be an air bearing system 207 in some embodiments. In some embodiments, the bearing system 207 may include a first foil bearing 288 that is supported between the first bearing support portion 284 and the shaft 209. The first foil bearing 288 may provide radial support during rotation of the shaft 209. The bearing system 207 may also include a second foil bearing 290 that is supported between the second bearing support portion 286 and the shaft 209. The second foil bearing 290 may provide additional radial support during rotation of the shaft 209. Moreover, the bearing system 207 may include a thrust bearing 292 that is disposed axially between the bearing housing member 282 and a seal plate 294.

The seal plate 294 may be generally flat with a central bore 296 extending therethrough. The seal plate 294 may be fixed on one axial side to the axial face of the bearing housing member 282. The other axial side of the seal plate 294 may be fixedly attached to a compressor housing cap member 298 of the compressor housing 222. The compressor housing cap member 298 may hemispherical or otherwise rounded with an inner side 297 and an outer side 299. The inner side 297 may face the seal plate 294, and the outer side 299 may face in the opposite axial direction. The outer side 299 may define a second axial end 295 and an exterior surface of the compressor device 200. The compressor housing cap member 298 may include a central axial opening 281. The central axial opening 281 may be open on the inner side 297 and closed on the outer side 299. The central axial opening 281 may be centered on the axis 105 and may have a rounded cross sectional profile.

The rotating group 203 may be received within the housing assembly 201 and supported by the bearing system 207. The shaft 209 may extend from the central recess 268, through the motor cavity 275, through the central bore 296, and into the central axial opening 281 of the compressor housing cap member 298. The rotor member 212 may be disposed within the stator 214.

Also, the compressor housing cap member 298 may be attached to the seal plate 294 such that they cooperatively house the compressor wheel 204 in the compressor section 210. The compressor section 210 may also include a compressor flow path 248 that fluidly connects the central axial opening 281 to a volute flow passage 244 of the housing cap member 298. The volute flow passage 244 may extend to and fluidly connect to a fluid outlet 291 extending out of the compressor housing cap member 298.

The rotating group 203 may further include a collar member 240 that is axially disposed between the compressor wheel 204 and the thrust bearing 292 on the shaft 209. The compressor device 200 may further include a seal member 242 that is radially disposed between the collar member 240 and the seal plate 294.

The compressor device 200 may additionally include a working fluid first flow path 301 and a working fluid second flow path 302. The working fluid first flow path 301 is illustrated in FIG. 2 with larger hollow arrows, and the working fluid second flow path 302 is illustrated in FIG. with comparatively smaller hollow arrows. As shown, these flow paths 301, 302 may include diverging branches and/or converging branches. These flow paths 301, 302 may be defined through spaces, cavities, tubes, or other openings through the housing assembly 201.

In some embodiments, the working fluid first flow path 301 may extend in a downstream direction from the first inlet 272, into the inlet cavity 266, and further into one or more axial openings 304 in the end plate 262. The working fluid first flow path 301 may further extend from the axial openings 304 and into the motor cavity 275, past the stator 214, and into one or more axial openings 306 in the bearing housing member 282. The axial openings 306 may be in fluid communication with one or more outer axial passages 293 in the seal plate 294. The axial passages 293 may be fluidly connected to arcuate re-direct segments 310 that are defined within the compressor housing cap member 298. The re-direct segments 310 (i.e., turn-around segments) may receive the working fluid as it flows axially in one direction and may turn the flow generally in the opposite axial direction. For example, the re-direct segments 310 may extend axially from an outer radial portion 312 of the inner side 297, may arcuately turn (i.e., bend) radially inward, and may turn back in the opposite axial direction to fluidly connect to the central axial opening 281 of the compressor section 210.

Thus, the working fluid first flow path 301 is configured to receive a first flow of a working fluid (e.g., the input flow 158 from the evaporator 156 of FIG. 1). The working fluid may flow through the inlet cavity 266. The invertor member 252 may receive heat from the chips 258, and the working fluid of the input flow 158 may receive this heat. The working fluid may flow past the stator 214 and may receive additional heat therefrom. This flow may move into the re-direct segments 310 and into the central axial opening 281 (i.e., the compressor inlet) to be compressed by the compressor section 210 and directed radially away from the compressor wheel 204 to the fluid outlet 291 of the compressor housing 222.

In some embodiments, there may be a bleed branch 320 that branches from the fluid outlet 291. The bleed branch 320 may be a tube or other passage that extends along an exterior of the compressor device 200.

The working fluid second flow path 302 may include a second inlet 314 into the housing assembly 201. The second inlet 314 may be fluidly connected to the fluid outlet 291 via the bleed branch 320. The second inlet 314 may extend radially into the motor housing member 274 along a first segment 321 to fluidly connect to the thrust bearing 292. A portion of the second flow path 302 may further extend downstream from the thrust bearing 292, axially through the second foil bearing 290 (i.e., radial bearing), where it merges with the working fluid first flow path 301 as described above.

The working fluid second flow path 302 may also include an axial branch 322. The axial branch 322 may branch away from the first segment and may extend axially from the second inlet 314, along the outer radial portion 278 of the motor housing member 274, toward the end plate 262. As such, flow through the axial branch 322 may be in the opposite axial direction from the flow direction along the working fluid first flow path 301 through the motor housing 216.

The working fluid second flow path 302 may further include a radial segment 330 that extends radially through the end plate 262 to fluidly connect the axial branch 322 to the central recess 268. The working fluid second flow path 302 may further extend in a downstream direction axially through the first foil bearing 288 (i.e., radial bearing) and into the motor cavity 275, where it merges with the working fluid first flow path 301 as described above.

Also, a portion of the second flow path 302 may extend downstream from the thrust bearing 292, and back outward radially through a radial segment 333 of the seal plate 294. This portion of the second flow path 302 may merge with the outer axial passages 293 so as to merge the second flow path 302 with the first flow path 301.

Thus, the compressor device 200 may effectively and efficiently compress the working fluid (e.g., the refrigerant of the fluid system 102) as it moves from the evaporator 156, into the first inlet 272, along the first flow path 301, to the fluid outlet 291. The first flow path 301 may also provide effective cooling for the controller section 230 and the motor section 220. The working fluid may be heated by these sections 220, 230, ensuring that the working fluid is in a gaseous state before reaching the compressor section 210. Thus, the compressor section 210 is unlikely to be negatively affected by liquid working fluid. In some embodiments, the controller section 230 may operate the motor 108 inefficiently such that additional heat is generated for ensuring the working fluid is gaseous.

The second flow path 302 provides relatively high pressure working fluid that is bled off of the fluid outlet 291 to provide cooling and support to the bearing system 207 before this stream merges with the first flow path 301. With this arrangement of flow paths, the compressor device 200 may be compact and lightweight. The housing assembly 201 may be constructed efficiently (e.g., by milling, casting, additive manufacturing, etc.), and the parts discussed above may be assembled efficiently.

Figure 3:
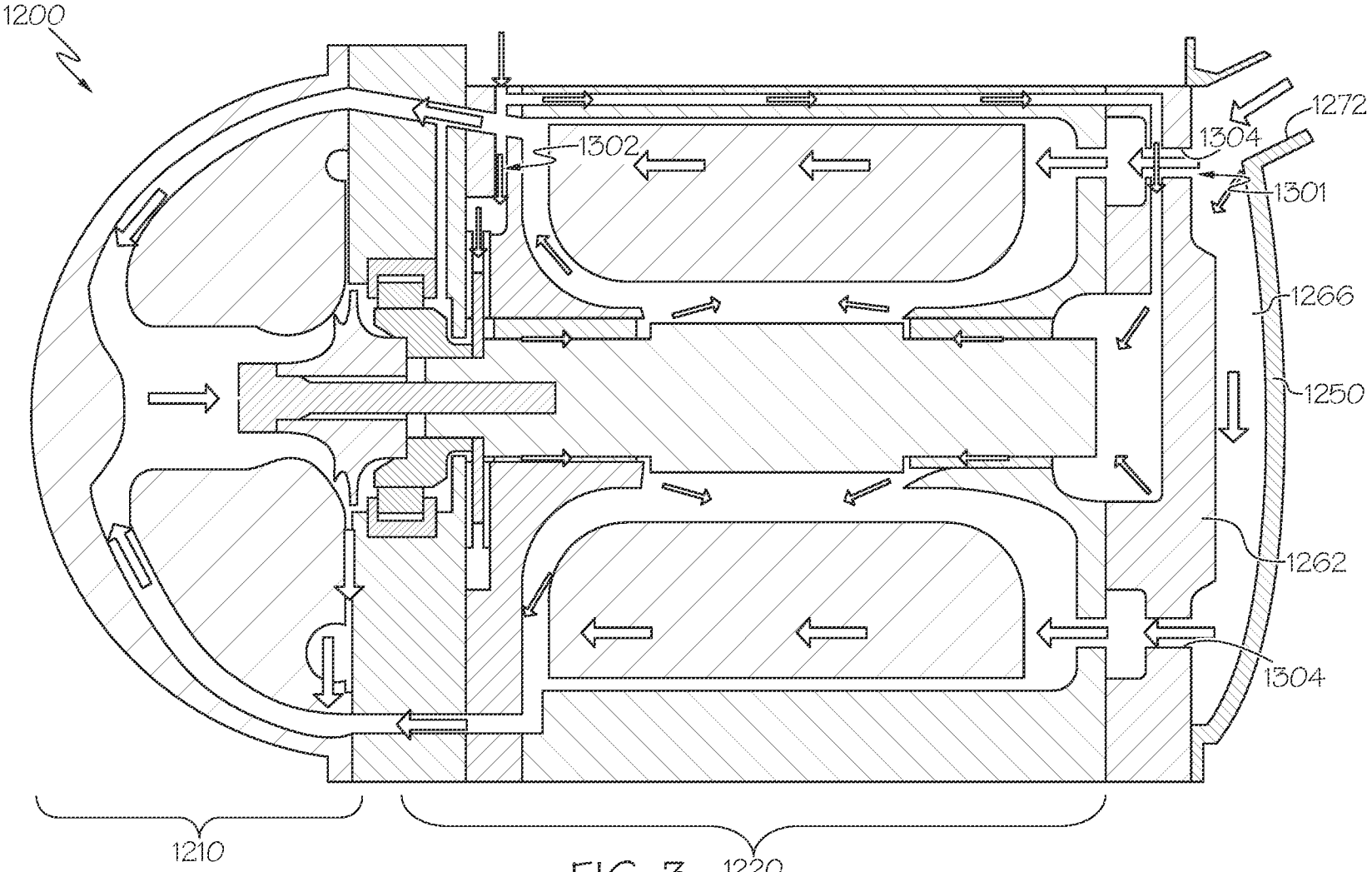
FIG. 3 is a cross-sectional schematic view of the compressor device of FIG. 1 according to additional example embodiments.

Referring now to FIG. 3, additional embodiments of the compressor device 1200 are discussed. The compressor device 1200 may be substantially similar to the embodiments discussed in connection with FIGS. 1 and 2 above. Features of the compressor device 1200 that correspond to those of FIGS. 1 and 2 are identified with corresponding reference numbers increased by 1000.

The compressor section 1210 may be substantially similar to the compressor section 210 of FIG. 2. The motor section 1220 may be attached to the compressor section 1210, and on the opposite end, the motor section 1220 may include the cover member 1250. As shown, the cover member 1250 may include the first inlet 1272, which may be directed substantially in the axial direction through the cover member 1250.

Furthermore, working fluid first flow path 1301, proximate the inlet 1272, may be different from the embodiments of FIG. 2. For example, the cover member 1250 may be contoured on its inner surface such that the inlet cavity 1266 contours toward the axial openings 1304 in the end plate 1262.

The working fluid second flow path 1302 is substantially the same as discussed above with respect to FIG. 2. Accordingly, the compressor device 1200 may provide effective and efficient compression of the working fluid. These features also make the compressor device 1200 compact and lightweight. Furthermore, the compressor device 1200 may also provide the same manufacturing efficiencies as discussed above.

It will also be appreciated that the cooling system of the present disclosure may provide sufficient cooling without a separate liquid cooling system. In other words, the cooling system may be integrated within a "waterless" compressor device. Stated differently, a separate water cooling jacket or other liquid coolant circuit is not necessary. Instead, the cooling paths disclosed herein may be sufficient to provide cooling. Thus, certain problems and challenges associated with liquid cooling systems can be avoided.

The cooling system provides other advantages as well. The flow paths of the present disclosure may simplify the construction of the compressor device. The motor cavity 275 in the present disclosure may act as a kind of reservoir, which allows for recirculation back to the compressor inlet. Instead of including external pipings for recirculating flow back to the compressor inlet, the motor cavity 275 distributes flow back to the compressor inlet. For example, flow from the bearings can be recirculated back in the motor cavity 275 and then to the compressor inlet. Thus, construction of the compressor device may be simple and have a low part count.

Moreover, there may be lower thrust loading on the rotating group 203 because of features of the present disclosure. There may be relatively low pressures inside the motor cavity 275. In some embodiments, the pressures in the motor cavity 275 may be similar to compressor inlet pressure, thereby reducing thrust loading.

Additionally, the flow paths disclosed according to the present disclosure may make it possible for liquid refrigerant to be injected for improved thermal management of the rotor, the stator, the bearings, as well as the invertor and other electronics. Also, to reduce the chance of liquid refrigerant entering the compressor stage, the controller section may selectively operate the compressor device to selectively increase operating heat, which converts any liquid refrigerant to the gaseous state before it flows further downstream through the compressor device.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A fluid compressor device comprising:

a housing;

a rotating group;

a bearing system that supports the rotating group for rotation within the housing about an axis of rotation;

a compressor section that is cooperatively defined by a compressor wheel of the rotating group and a compressor housing of the housing, the compressor housing including a compressor inlet;

a motor section with an electric motor that is housed within a motor housing of the housing;

a working fluid first flow path that extends in a downstream direction through the motor housing to the compressor inlet, the working fluid first flow path configured to receive a first flow of a working fluid that flows downstream through the motor housing past the electric motor and into the compressor inlet to be compressed by the compressor section;

a working fluid second flow path extending through the housing, the working fluid second flow path configured to receive a portion of the working fluid from the compressor section and direct the portion to the bearing system before merging with the working fluid first flow path; and a controller section that is configured to control the electric motor, the controller section including a cavity that defines a portion of the working fluid first flow path.

2. The compressor device of claim 1, wherein the compressor housing includes an axial opening and a re-direct segment that extends in a downstream direction from the axial opening, that turns radially, and that fluidly connects to the compressor inlet.

3. The compressor device of claim 2, wherein the re-direct segment arcuately turns radially.

4. The compressor device of claim 2, wherein the re-direct segment turns radially inward.

5. The compressor device of claim 1, wherein the working fluid second flow path includes a segment that extends radially within the housing to a thrust bearing of the bearing system and, further downstream, extends axially to support a radial bearing member before merging with the working fluid first flow path.

6. The compressor device of claim 5, wherein the working fluid second flow path includes another segment that branches from the segment, the other segment extending axially through the motor housing.

7. The compressor device of claim 6, wherein the other segment defines a flow direction that is opposite that of the working fluid first flow path through the housing.

8. The compressor device of claim 1, wherein the working fluid first flow path includes a first inlet into the cavity of the controller section, the motor housing defining another portion of the working fluid first flow path that is downstream of the cavity.

9. The compressor device of claim 1, wherein the compressor housing includes a compressor outlet; and wherein the working fluid second flow path includes a second inlet into the housing, the second inlet being fluidly connected to the compressor outlet via a bleed branch.

10. The compressor device of claim 1, further comprising a controller section; and wherein the motor section is disposed axially between the compressor section and the controller section along the axis of rotation.

11. A method of manufacturing a compressor device comprising:

providing a rotating group;

supporting the rotating group about an axis of rotation within a housing with a bearing system to define a compressor section and a motor section, the compressor section being cooperatively defined by a compressor wheel of the rotating group and a compressor housing of the housing, the compressor housing including a compressor inlet, the motor section including an electric motor that is housed within a motor housing of the housing;

defining a working fluid first flow path that extends in a downstream direction through the motor housing to the compressor inlet, the working fluid first flow path configured to receive a first flow of a working fluid that flows downstream through the motor housing past the electric motor and into the compressor inlet to be compressed by the compressor section;

defining a working fluid second flow path extending through the housing, the working fluid second flow path configured to receive a portion of the working fluid from the compressor section and direct the portion to the bearing system before merging with the working fluid first flow path; and defining a controller section that is configured to control the electric motor, the controller section including a cavity that defines a portion of the working fluid first flow path.

12. The method of claim 11, wherein the compressor housing includes an axial opening and a re-direct segment that extends in a downstream direction from the axial opening, that turns radially, and that fluidly connects to the compressor inlet.

13. The method of claim 12, wherein the re-direct segment arcuately turns radially inward.

14. The method of claim 11, wherein the working fluid second flow path includes a segment that extends radially within the housing to a thrust bearing of the bearing system and, further downstream, extends axially to support a radial bearing member before merging with the working fluid first flow path.

15. The method of claim 14, wherein the working fluid second flow path includes another segment that branches from the segment, the other segment extending axially through the motor housing.

16. The method of claim 11, wherein the working fluid first flow path includes a first inlet into the cavity of the controller section, the motor housing defining another portion of the working fluid first flow path that is downstream of the cavity.

17. A fluid compressor device comprising:

a housing;

a rotating group;

a bearing system that supports the rotating group for rotation within the housing about an axis of rotation;

a compressor section that is cooperatively defined by a compressor wheel of the rotating group and a compressor housing of the housing, the compressor housing including a compressor inlet, the compressor housing including an axial opening, the compressor housing including a re-direct segment that extends in a first axial downstream direction from the axial opening, that arcuately turns radially inward, and that extends in a second axial downstream direction that is opposite the first axial downstream direction before fluidly connecting to the compressor inlet;

a motor section with an electric motor that is housed within a motor housing of the housing;

a working fluid first flow path that extends in a downstream direction through the motor housing to the compressor inlet, the working fluid first flow path configured to receive a first flow of a working fluid that flows downstream through the motor housing past the electric motor and into the compressor inlet to be compressed by the compressor section; and a working fluid second flow path extending through the housing, the working fluid second flow path configured to receive a portion of the working fluid from the compressor section and direct the portion to the bearing system before merging with the working fluid first flow path.

18. The fluid compressor device of claim 17, wherein the working fluid second flow path includes a segment that extends radially within the housing to a thrust bearing of the bearing system and, further downstream, extends axially to support a radial bearing member before merging with the working fluid first flow path.

19. The fluid compressor device of claim 17, wherein the compressor housing includes a compressor outlet; and wherein the working fluid second flow path includes a second inlet into the housing, the second inlet being fluidly connected to the compressor outlet via a bleed branch.

20. The fluid compressor device of claim 17, further comprising a controller section; and wherein the motor section is disposed axially between the compressor section and the controller section along the axis of rotation.

* * * * *